US009337547B2

(12) United States Patent
Kim et al.

(10) Patent No.: US 9,337,547 B2
(45) Date of Patent: May 10, 2016

(54) INTERNAL ANTENNA HAVING WIDEBAND CHARACTERISTIC

(71) Applicant: LS Mtron Ltd., Anyang-si (KR)

(72) Inventors: Tae-Hyung Kim, Gunpo-Si (KR); Ki-Hyun Kong, Gunpo-Si (KR); Suk-Ki Koo, Gwangmyeong-Si (KR); Byung-Je Lee, Seoul (KR); Hyun-Ho Wi, Seoul (KR); Byeong-Kwan Kim, Seoul (KR)

(73) Assignee: LS MTRON LTD., Anyang-Si, Gyeonggi-Do (KR)

( * ) Notice: Subject to any disclaimer, the term of this patent is extended or adjusted under 35 U.S.C. 154(b) by 273 days.

(21) Appl. No.: 13/951,749

(22) Filed: Jul. 26, 2013

(65) Prior Publication Data

US 2014/0028519 A1 Jan. 30, 2014

(30) Foreign Application Priority Data

Jul. 27, 2012 (KR) ..... 10-2012-0082510

(51) Int. Cl.

| | |
|---|---|
| ***H01Q 1/24*** | (2006.01) |
| ***H01Q 21/00*** | (2006.01) |
| ***H01Q 1/38*** | (2006.01) |
| ***H01Q 1/52*** | (2006.01) |
| ***H01Q 9/42*** | (2006.01) |
| ***H01Q 21/28*** | (2006.01) |
| ***H01Q 5/25*** | (2015.01) |
| ***H01Q 5/371*** | (2015.01) |
| ***H01Q 5/378*** | (2015.01) |
| ***H01Q 5/40*** | (2015.01) |

(52) U.S. Cl.

CPC ..... *H01Q 21/0075* (2013.01); *H01Q 1/243* (2013.01); *H01Q 1/38* (2013.01); *H01Q 1/521* (2013.01); *H01Q 5/25* (2015.01); *H01Q 5/371* (2015.01); *H01Q 5/378* (2015.01); *H01Q 5/40* (2015.01); *H01Q 9/42* (2013.01); *H01Q 21/28* (2013.01)

(58) Field of Classification Search

CPC ..... H01Q 21/0075; H01Q 1/243; H01Q 1/38
USPC ..... 343/702, 700 MS, 844, 846
See application file for complete search history.

(56) References Cited

U.S. PATENT DOCUMENTS

| | | | | |
|---|---|---|---|---|
| 6,147,650 | A * | 11/2000 | Kawahata et al. | 343/700 MS |
| 6,281,848 | B1 * | 8/2001 | Nagumo et al. | 343/700 MS |
| 6,320,545 | B1 * | 11/2001 | Nagumo et al. | 343/700 MS |
| 6,323,811 | B1 * | 11/2001 | Tsubaki et al. | 343/700 MS |
| 8,952,859 | B2 * | 2/2015 | Tan | 343/803 |

(Continued)

FOREIGN PATENT DOCUMENTS

| | | | |
|---|---|---|---|
| CN | 200994001 | Y | 12/2007 |
| CN | 102544729 | A | 7/2012 |

(Continued)

*Primary Examiner* — Hoanganh Le
(74) *Attorney, Agent, or Firm* — LRK Patent Law Firm

(57) ABSTRACT

An internal antenna having a wideband characteristic includes a printed circuit board, a first antenna unit fed with electricity from a feeding unit of the printed circuit board, and a second antenna unit spaced apart from the first antenna unit by a predetermined distance and indirectly fed with electricity by means of coupling to the first antenna unit, wherein the second antenna unit is indirectly fed with electricity with a phase difference from the first antenna unit due to an electric distance from a feeding point of the first antenna unit.

13 Claims, 10 Drawing Sheets

(56) References Cited

U.S. PATENT DOCUMENTS

| | | | | |
|---|---|---|---|---|
| 2002/0030626 | A1 | 3/2002 | Nagumo et al. | |
| 2011/0263289 | A1* | 10/2011 | Vance | 455/550.1 |
| 2013/0088404 | A1* | 4/2013 | Ramachandran | H01Q 1/243 343/853 |

FOREIGN PATENT DOCUMENTS

| | | | |
|---|---|---|---|
| EP | 0 942 488 | A2 | 9/1999 |
| KR | 10-2011-0010416 | A | 2/2011 |
| KR | 10-2001-0098511 | | 11/2011 |
| WO | 2011/064444 | A1 | 6/2011 |

* cited by examiner

INTERNAL ANTENNA HAVING WIDEBAND CHARACTERISTIC

CROSS-REFERENCE TO RELATED APPLICATION

The present application claims priority to Korean Patent Application No. 10-2012-0082510 filed in the Republic of Korea on Jul. 27, 2012, the disclosures of which are incorporated herein by reference.

BACKGROUND OF THE DISCLOSURE

1. Field of the Disclosure

The present disclosure relates to an internal antenna, and more particularly, to an internal antenna, which may have a wideband characteristic in a device with a narrow space like a mobile communication terminal and ensure isolation and correlation of a multi input multi output (MIMO) system.

2. Description of the Related Art

In the wireless communication technology, as voice communication service is associated with high-quality multimedia service through a mobile terminal, fusion with a next-generation wireless communication service such as long term evolution (LTE) attracts great interest.

Generally, a communication system based on voice communication service uses a single input single output (SISO) system using a single antenna unit for the sake of a narrow-band channel within a limited frequency range. However, the SISO system using a single antenna may not easily transfer a large amount of data at a high speed in the narrow-band channel, and thus more advanced techniques are needed.

For this reason, there is needed a multiple input multiple output (MIMO) technique which is a next-generation wireless transmission technique capable of transmitting/receiving data faster with less errors by independently operating a plurality of antennas.

By using multiple antennas at transmitting and receiving terminals, the MIMO system may transmit data at a high speed without increasing the number of allocated frequencies used by the entire system, which allows efficient use of the limited frequency resources. The MIMO system is therefore widely used in the art.

However, in order to mount the MIMO antennas in an inner space of a slim mobile communication terminal, it is necessary to overcome deteriorated transmitting/receiving performance caused by mutual electromagnetic coupling or insufficient isolation among the mounted antennas.

In order to solve this problem, it may be conceived to install antennas spaced apart from each other by $\lambda/2$ or above (here, $\lambda$ is a wavelength of radio waves emitted from the antennas). However, since a small antenna system has a limited space for antennas installed therein, it may be impossible to install antennas distantly from each other and thus the above problem cannot be solved.

Meanwhile, considering the recent trend of the antenna technology, a next-generation mobile communication system should have a plurality of antennas in a mobile communication terminal and use a low-frequency LTE band. Therefore, at least two MIMO antennas should be mounted in the terminal.

However, in order to support the low-frequency LTE band, an antenna having a wideband characteristic including the low-frequency band is required, and a sufficient ground as much as ¼ wavelength of the use frequency should be ensured. However, since a mobile communication terminal has a small size and a limited space, it is very difficult to satisfy such design requirements.

Therefore, in the technical field of the present disclosure, there is an urgent demand to develop an antenna technique which may ensure isolation and correlation of a MIMO system while having a wideband characteristic including a low-frequency band.

SUMMARY OF THE DISCLOSURE

The present disclosure is designed to solve the problems of the prior art, and therefore the present disclosure is directed to providing an internal antenna, which may have a wideband characteristic including a low-frequency band in a device having a narrow space like a mobile communication terminal and ensure isolation and correlation of a MIMO system.

In one aspect of the present disclosure, there is provided an internal antenna having a wideband characteristic, which includes a printed circuit board; a first antenna unit fed with electricity from a feeding unit of the printed circuit board; and a second antenna unit spaced apart from the first antenna unit by a predetermined distance and indirectly fed with electricity by means of coupling to the first antenna unit, wherein the second antenna unit is indirectly fed with electricity with a phase difference from the first antenna unit due to an electric distance from a feeding point of the first antenna unit.

Preferably, the second antenna unit may be indirectly fed with electricity with a phase difference of 90 degrees from the first antenna unit.

Preferably, the second antenna unit may have an indirect feeding point spaced apart from the feeding point of the first antenna unit as much as an electric distance equal to ¼ of a wavelength $\lambda$ which corresponds to a central frequency of an operating frequency band of the first antenna unit.

Preferably, the first antenna unit may include a feeding port connected to the feeding unit of the printed circuit board; a first antenna pattern extending from the feeding port to emit an electromagnetic wave outwards; and a ground line connected to the first antenna pattern and connected to a ground unit of a common ground of the printed circuit board.

Preferably, the first antenna pattern may have a terminal located at an edge of the printed circuit board, and an electric distance from the feeding port to the terminal of the first antenna pattern may equal to ¼ of a wavelength $\lambda$ which corresponds to a central frequency of an operating frequency band of the first antenna unit.

Preferably, the first antenna unit may further include an impedance matching line diverging from the first antenna pattern and improving an impedance matching characteristic of the first antenna unit.

Preferably, the impedance matching line may vertically diverge from the first antenna pattern at a portion in which a surface current is strong, and the impedance matching line may be bent at least once so that a terminal of the impedance matching line is oriented toward a ground port of the first antenna unit.

Preferably, the terminal of the impedance matching line may be arranged in parallel to the ground line of the first antenna unit on the same plane or on different planes.

Preferably, the second antenna unit may include an indirect feeding line connected to a ground unit of a common ground of the printed circuit board and indirectly fed with electricity by being spaced apart from the first antenna unit by a predetermined distance; and a second antenna pattern extending from the indirect feeding line and emitting an electromagnetic wave, which has a resonance frequency different from that of the first antenna unit, outwards.

Preferably, the second antenna unit may have a relatively lower resonance frequency in comparison to the first antenna unit.

Preferably, the second antenna pattern may extend from the indirect feeding line and is disposed on the same plane as or on a different plane from the first antenna unit.

Preferably, the second antenna pattern may be bent at least once so that a terminal of the second antenna pattern is located at an edge of the printed circuit board.

Preferably, the second antenna pattern may have a meander form.

Preferably, the first antenna unit and the second antenna unit may be connected to the same surface of the printed circuit board. In another case, the first antenna unit may be connected to one surface of the printed circuit board, and the second antenna unit may be connected to the other surface of the printed circuit board.

Preferably, the first antenna unit and the second antenna unit may be formed in the space or fixed to a dielectric block formed having a predetermined dielectric constant.

In the present disclosure, the first antenna unit and the second antenna unit may be located at one end of the printed circuit board, and the internal antenna may further include a third antenna unit provided at the other end of the printed circuit board and fed with electricity from a feeding unit other than the first antenna unit.

Preferably, the first and second antenna unit and the third antenna unit may be located on the same side with the printed circuit board being interposed therebetween.

Preferably, the internal antenna may further include a current conversion unit disposed at the other end of the printed circuit board at which the third antenna unit is located so that the current conversion unit is spaced apart from the third antenna unit by a predetermined distance, the current conversion unit being connected to a common ground of the printed circuit board, and the current conversion unit may be coupled to the third antenna unit to guide a current, induced from the third antenna unit, toward the third antenna unit again.

According to the present disclosure, since an additional antenna having a different phase difference and allowing indirect feeding is provided in a device having a narrow space like a mobile communication terminal, an internal antenna may have a wideband characteristic having a low-frequency band without offsetting a resonance frequency. In addition, since it is possible to design an antenna having a wideband characteristic in a small size and improve isolation and correlation between antenna units without demanding a radio link control (RLC) device or additional structures for expanding the bandwidth, the present disclosure may be applied to next-generation wireless communication service such as LTE which is operated in a low-frequency band as well as in a general communication band.

BRIEF DESCRIPTION OF THE DRAWINGS

The accompanying drawings illustrate preferred embodiments of the present disclosure and, together with the foregoing disclosure, serve to provide further understanding of the technical spirit of the present disclosure. However, the present disclosure is not to be construed as being limited to the drawings in which.

| Reference Symbols | |
|---|---|
| 100: first antenna unit | 200: second antenna unit |
| 110: feeding port | 210: indirect feeding line |
| 120: first antenna pattern | 220: second antenna pattern |
| 130: ground line | |

DESCRIPTION OF THE PREFERRED EMBODIMENT

Hereinafter, preferred embodiments of the present disclosure will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation. Therefore, the description proposed herein is just a preferable example for the purpose of illustrations only, not intended to limit the scope of the disclosure, so it should be understood that other equivalents and modifications could be made thereto without departing from the spirit and scope of the disclosure.

Figure 1:
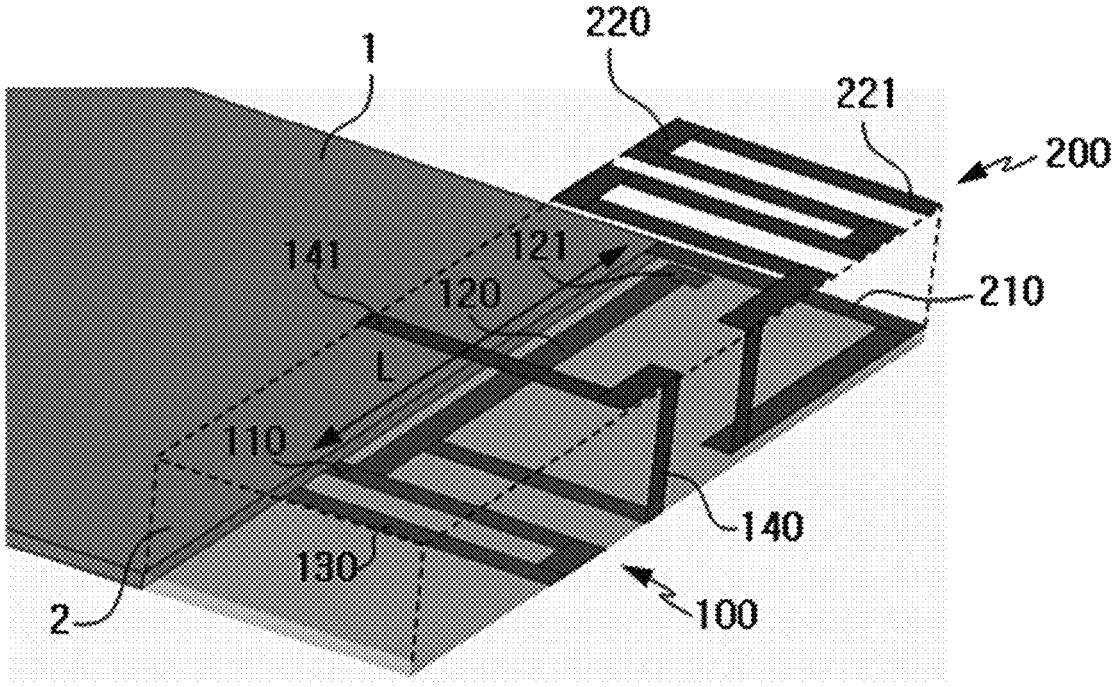
FIG. 1 is a perspective view showing an internal antenna having a wideband characteristic according to an embodiment of the present disclosure.

FIG. 1 is a perspective view showing an internal antenna having a wideband characteristic according to an embodiment of the present disclosure.

Referring to FIG. 1, an internal antenna having a wideband characteristic according to an embodiment of the present disclosure includes a printed circuit board 1, a first antenna unit 100 fed with electricity from a feeding unit of the printed circuit board 1, a second antenna unit 200 spaced apart from the first antenna unit 100 by a predetermined distance and indirectly fed with electricity by means of coupling to the first antenna unit 100, and a dielectric block 2 having a predetermined dielectric constant to which the first antenna unit 100 and the second antenna unit 200 are fixed.

Electronic parts for operating various functions of a mobile communication terminal are mounted on the printed circuit board 1, and the printed circuit board 1 is composed of a portion at which the feeding unit for feeding electricity to the first antenna unit 100 is located and a common ground portion at which the first and second antenna units 100, 200 are commonly grounded. The common ground may be formed by patterning metallic material on one surface of the printed circuit board 1, but the present disclosure is not limited thereto.

The first and second antenna units 100, 200 are formed at a single dielectric block 2 located at one end of the printed circuit board 1, and the first antenna unit 100 and the second antenna unit 200 are disposed to be spaced apart from each other by a predetermined distance.

The first antenna unit 100 includes a feeding port 110 connected to the feeding unit of the printed circuit board 1, a first antenna pattern 120 extending from the feeding port 110 to emit an electromagnetic wave outwards, and a ground line 130 connected to the first antenna pattern 120 and connected to a ground unit located at the common ground of the printed circuit board 1.

The feeding port 110 of the first antenna unit 100 is preferably positioned at a location which may have an electric distance equal to ¼ of a wavelength λ corresponding to a central frequency of an operating frequency band of the first antenna unit 100, in at least one side for the entire length of the printed circuit board 1. This may gives an electric distance from the feeding port 110 to a feeding point of the second antenna unit 200, described later.

The first antenna pattern 120 of the first antenna unit 100 has a shape of an inverted L-type antenna which may cover a low-frequency band. For example, the first antenna pattern 120 is designed to cover the band of 824 to 960 MHz of GSM850/900 (Global System for Mobile 850/900). However, the present disclosure is not limited to a specific antenna shape, and the antenna of the present disclosure may be modified to have various shapes.

The first antenna pattern 120 extends from the feeding point at which the feeding port 110 is located, so that a terminal 121 may be located at an edge of the printed circuit board 1. At this time, the first antenna pattern 1 is bent at least once so that the terminal 121 is oriented toward the outer side of the printed circuit board 1. In addition, the first antenna pattern 120 is formed so that the electric distance L from the feeding port 110 to the terminal 121 of the first antenna pattern 120 has a length equal to ¼ of the wavelength λ corresponding to a central frequency of the operating frequency band.

The ground line 130 of the first antenna unit 100 is connected to the first antenna pattern 120 to be connected to the ground unit of the common ground of the printed circuit board 1. The ground line 130 is bent at least once to extend perpendicularly from the first antenna pattern 120 and is connected to the ground unit of the common ground of the printed circuit board 1.

In addition, the first antenna unit 100 further includes an impedance matching line 140 diverging from the first antenna pattern 120 and improving an impedance matching characteristic of the first antenna unit 100.

The impedance matching line 140 perpendicularly extends from a portion of the first antenna pattern 120 in which a surface current is strong, and is bent at least once so that a terminal 141 is oriented toward the ground port 110 of the first antenna unit 100. At this time, the terminal 141 of the impedance matching line 140 may be arranged in parallel to the ground line 130 of the first antenna unit 100 on the same plane or formed with a 3D structure at the dielectric block 2 to be in parallel with the ground line 130 of the first antenna unit 100 on different planes. The impedance matching line 140 serves as a capacitance of the first antenna pattern 120 to improve the impedance matching characteristic.

The second antenna unit 200 is disposed to be spaced apart from the first antenna unit 100 by a predetermined distance to indirectly feed electricity by means of coupling to the first antenna unit 100. The second antenna unit 200 includes an indirect feeding line 210 connected to the ground unit of the common ground of the printed circuit board 1 and indirectly fed with electricity by being spaced apart from the first antenna unit 100 by a predetermined distance, and a second antenna pattern 220 extending from the indirect feeding line 210 and emitting an electromagnetic wave, which has a resonance frequency different from that of the first antenna unit 100, outwards.

The indirect feeding line 210 of the second antenna unit 200 is connected to the ground unit located at the edge of the printed circuit board 1 and spaced apart from the terminal 121 of the first antenna pattern 120 of the first antenna unit 100 to indirectly feed electricity by means of coupling to the first antenna unit 100. At this time, the indirect feeding line 210 indirectly feeds electricity due to a phase difference caused by different electric distances from the feeding port 110 which is a feeding point of the first antenna unit 100.

Preferably, the indirect feeding line 210 of the second antenna unit 200 is positioned at a location which allows indirect feeding to have a phase difference of 90 degrees with the first antenna unit 100. In other words, the indirect feeding line 210 serving as the indirect feeding point of the second antenna unit 200 is located to have an electric distance equal to ¼ of the wavelength λ corresponding to a central frequency of the operating frequency band of the first antenna unit 100 from the feeding port 110 serving as the feeding point of the first antenna unit 100. This may be enabled by positioning the indirect feeding line 210 at the terminal 121 of the first antenna pattern 120 whose electric distance L from the feeding port 110 of the first antenna unit 100 equals to ¼ of the wavelength λ corresponding to the central frequency of the operating frequency band.

In the present disclosure, the second antenna unit 200 is not fed with electricity from a separate feeding unit but indirectly fed by means of coupling to the first antenna unit 100, and at this time an electric distance is present between the feeding port 110 serving as a feeding point of the first antenna unit 100 and the indirect feeding line 210 serving as a feeding point of the second antenna unit 200 so that electricity may be fed with a phase difference of 90 degrees. Therefore, when the first antenna unit 100 has a maximum current distribution value, the second antenna unit 200 may have a minimum current distribution value. On the contrary, when the second antenna unit 200 has a maximum current distribution value, the first antenna unit 100 may have a minimum current distribution value. In this way, the influence between the first and second antenna units 100, 200 may be minimized and the first and second antenna units 100, 200 may operate independently. In other words, since the first antenna unit 100 and the second antenna unit 200 are fed with electricity while keeping a phase difference of 90 degrees, the resonances of the first and second antenna units 100, 200 are not offset by each other. Therefore, both antennas may have good electric characteristics and their bands are enlarged.

The second antenna pattern 220 of the second antenna unit 200 has an antenna pattern capable of emitting an electromagnetic wave having a resonance frequency different from that of the first antenna unit 100 and is preferably designed to have a relatively lower resonance frequency in comparison to the first antenna unit 100. For example, the second antenna pattern 220 is designed to cover the band of LTE13 (Long Term Evolution class13), namely 746 to 787 MHz. However, the present disclosure is not limited to such an antenna pattern but may be modified into various patterns.

The second antenna pattern 220 extends from the indirect feeding line 210 and is bent at least once to be formed with a 3D structure at the dielectric block 2 so that a terminal 211 may be located at the edge of the printed circuit board 1. At this time, the terminal 221 of the second antenna pattern 220 is arranged in parallel to the indirect feeding line 210 on different planes. In addition, the second antenna pattern 220 has a meander shape which is bent in a zigzag pattern. This increases the length of the second antenna pattern 220 in a spatial aspect, thereby facilitating efficient use in a narrow space.

As described above, the internal antenna having a wideband characteristic according to the present disclosure includes the first antenna unit 100 directly fed with electricity from the feeding unit of the printed circuit board 1 and the second antenna unit 200 indirectly fed with electricity from the first antenna unit 100, and allows the first and second antenna units 100, 200 to be fed with electricity due to a phase difference caused by different electric distances between both antenna units 100, 200 and the feeding point so that the first and second antenna units 100, 200 may operate independently while minimizing an influence between them. Therefore, two antennas having different resonance frequencies may operate independently with electricity supplied from a single feeding unit, which reduces power consumption and enlarges the band.

Figure 2:
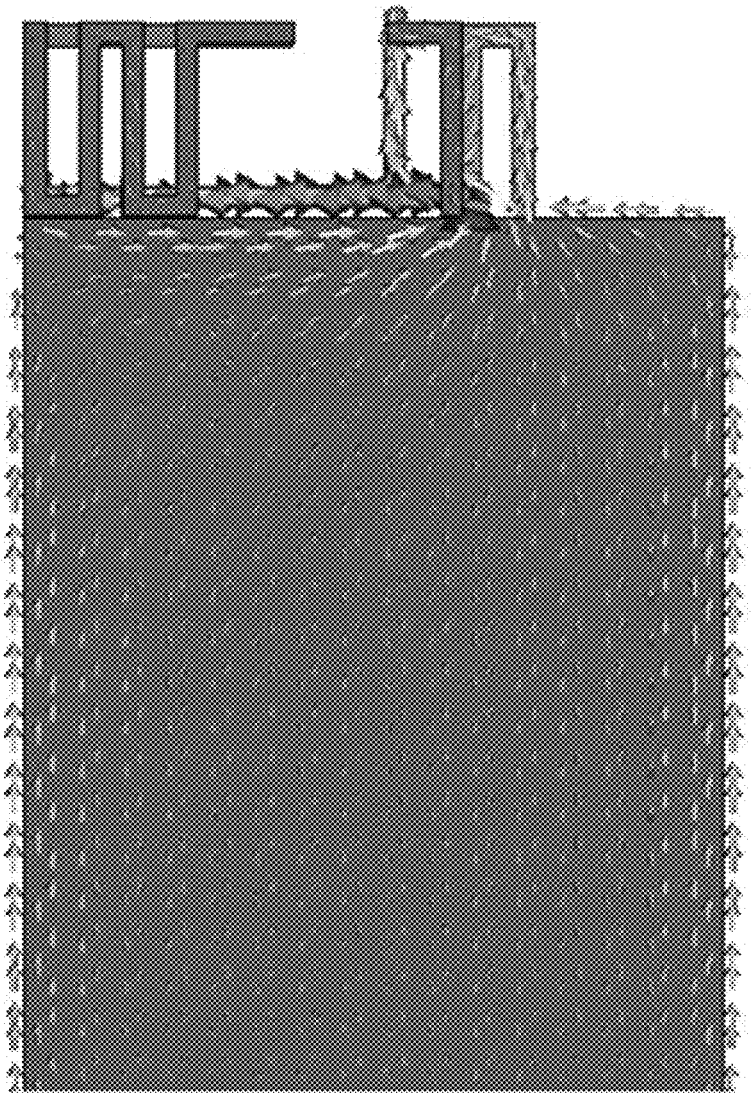
FIG. 2 is a diagram showing current distribution in an operating band of a first antenna unit employed in the internal antenna of FIG. 1.
Figure 3:
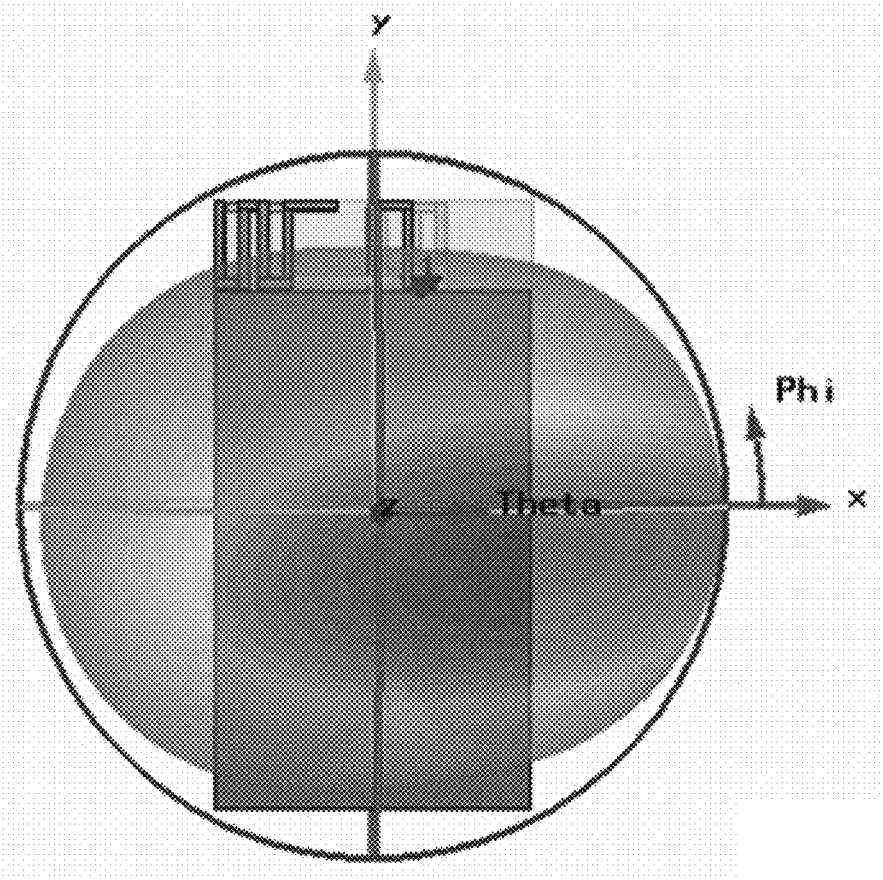
FIG. 3 is a diagram showing a 3D radiation pattern in the operating band of the first antenna unit employed in the internal antenna of FIG. 1.
Figure 4:
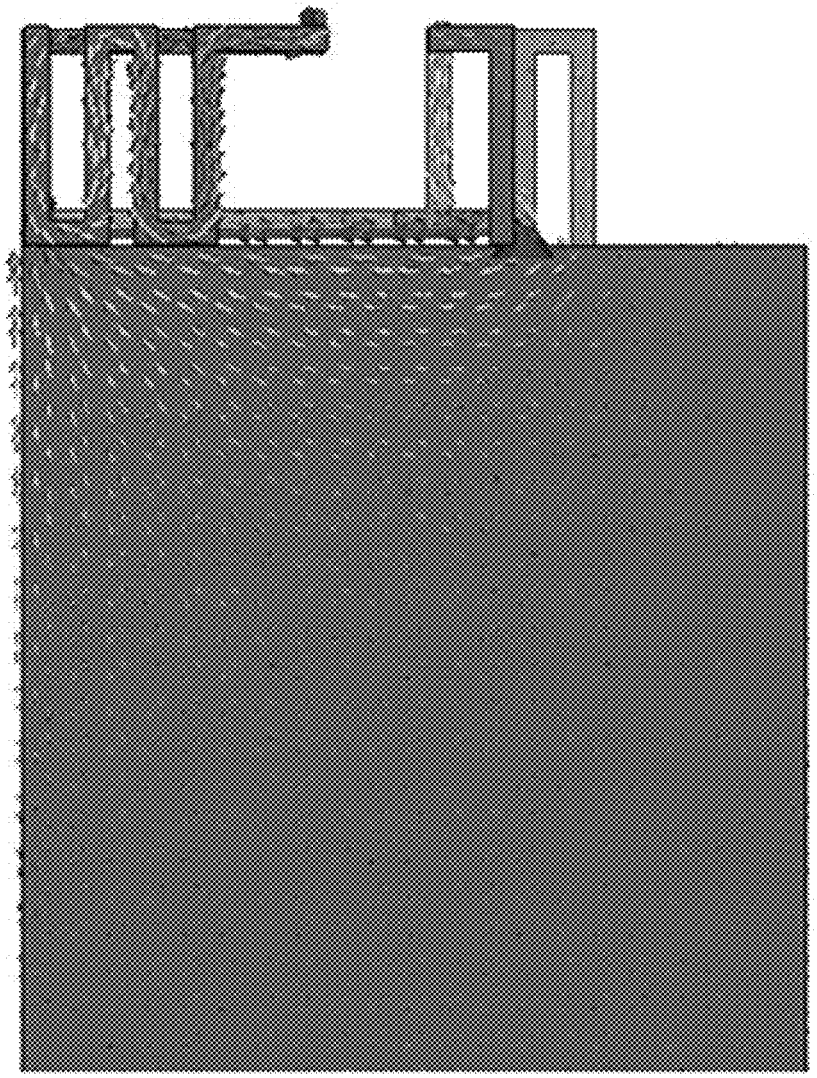
FIG. 4 is a diagram showing current distribution in an operating band of a second antenna unit employed in the internal antenna of FIG. 1.
Figure 5:
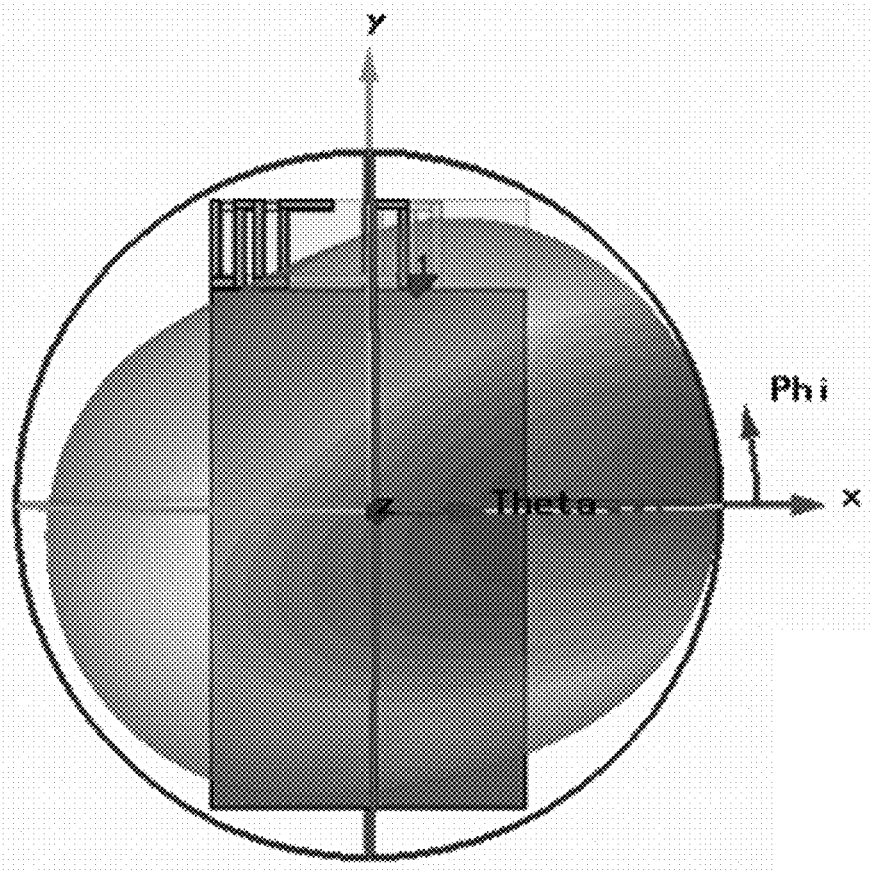
FIG. 5 is a diagram showing a 3D radiation pattern in the operating band of the second antenna unit employed in the internal antenna of FIG. 1.
Figure 6:
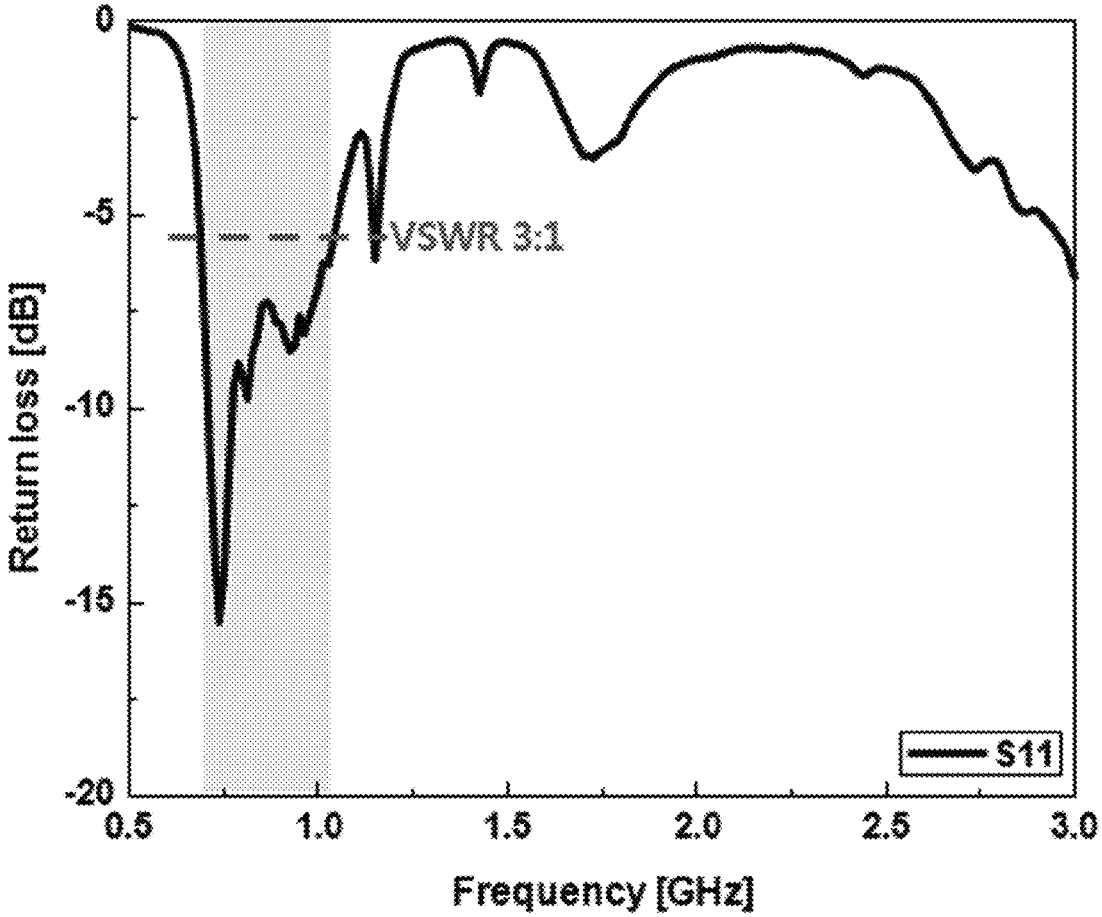
FIG. 6 is a graph showing characteristics of the internal antenna of FIG. 1.

FIG. 2 is a diagram showing current distribution in an operating band of the first antenna unit employed in the internal antenna of FIG. 1, FIG. 3 is a diagram showing a 3D radiation pattern in the operating band of the first antenna unit employed in the internal antenna of FIG. 1, FIG. 4 is a diagram showing current distribution in an operating band of the second antenna unit employed in the internal antenna of FIG. 1, FIG. 5 is a diagram showing a 3D radiation pattern in the operating band of the second antenna unit employed in the internal antenna of FIG. 1, and FIG. 6 is a graph showing characteristics of the internal antenna of FIG. 1.

First, FIGS. 2 and 3 shows a current distribution and a 3D radiation pattern in the band of 950 MHz which is an operating band of the first antenna unit 100, when the first antenna unit 100 is fed with electricity. As shown in FIGS. 2 and 3, a current flow is uniformly distributed at the common ground of the printed circuit board 1, and the radiation pattern is vertically distributed with respect to the length direction of the printed circuit board 1.

Next, FIGS. 4 and 5 shows a current distribution and a 3D radiation pattern in the band of 750 MHz which is an operating band of the second antenna unit 200, when the first antenna unit 100 is fed with electricity. As shown in FIGS. 4 and 5, the current at the common ground of the printed circuit board 1 flows to the left top portion, and the radiation pattern has a diagonally distributed shape inclined toward the right top portion with respect to the length direction of the printed circuit board 1.

In other words, the second antenna unit 200 is indirectly fed with electricity from the first antenna unit 100 to operate the antenna, and the terminal 221 of the second antenna pattern 220 of the second antenna unit 200 is located toward the edge of the printed circuit board 1. For this reason, the radiation pattern may be inclined diagonally, which ensures a low correlation (ECC) when a MIMO antenna is disposed at a side opposite to the printed circuit board 1 where the first and second antenna units 100, 200 are located.

In addition, it may be understood that the first and second antenna units 100, 200 formed as above may cover a wide band since the first and second antenna units 100, 200 may operate simultaneously without offsetting each other as shown in FIG. 6.

Meanwhile, in the above embodiment, the antenna of a single input single output (SISO) system having a wideband characteristic by locating an internal antenna having a wideband characteristic at one end of the printed circuit board 1 has been described. However, the present disclosure is not limited thereto, and an antenna of a multiple input multiple output (MIMO) system may also be implemented as another embodiment. Hereinafter, another embodiment of the present disclosure will be described with reference to FIG. 7.

Figure 7:
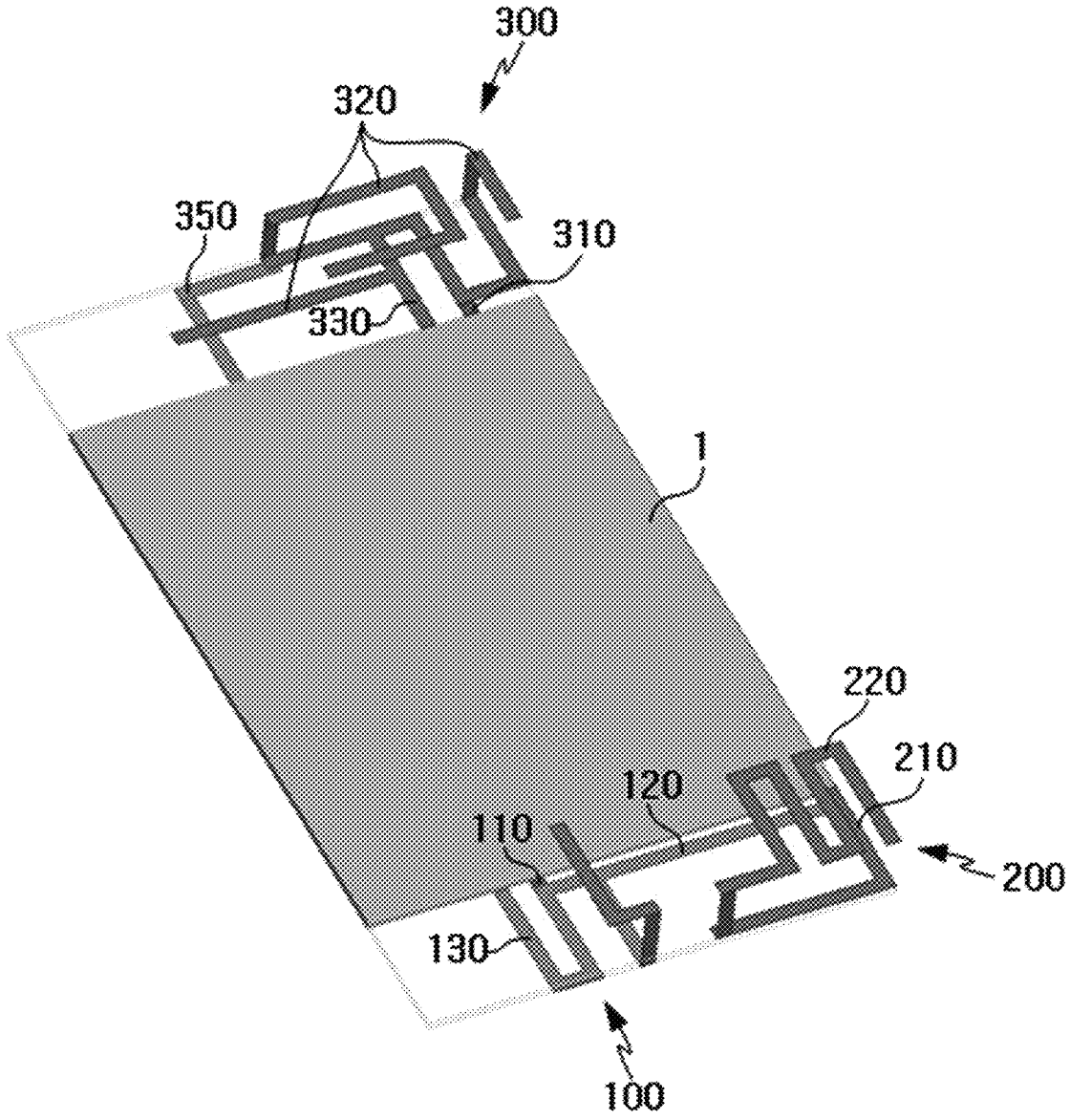
FIG. 7 is a perspective view showing an internal antenna having a wideband characteristic according to another embodiment of the present disclosure.

FIG. 7 is a perspective view showing an internal antenna having a wideband characteristic according to another embodiment of the present disclosure.

Referring to FIG. 7, the internal antenna having a wideband characteristic according to another embodiment of the present disclosure includes a printed circuit board 1, a first antenna unit 100 located at one end of the printed circuit board 1 and fed with electricity from a feeding unit of the printed circuit board 1, a second antenna unit 200 spaced apart from the first antenna unit 100 located at one end of the printed circuit board 1 by a predetermined distance and indirectly fed with electricity by means of coupling to the first antenna unit 100, and a third antenna unit 300 located at the other end of the printed circuit board 1 and fed with electricity from another feeding unit of the first antenna unit 100.

The internal antenna having a wideband characteristic according to another embodiment of the present disclosure is substantially identical to the internal antenna of the former embodiment, except that the third antenna unit 300 is additionally provided at the other end of the printed circuit board 1 in addition to the first and second antenna units 100, 200 located at one end of the printed circuit board 1 in order to configure an antenna of a MIMO system supporting multiple input/output. Therefore, the same components as in the former embodiment, other than the third antenna unit 300, will not be described in detail here.

Electronic components for operating various functions of a mobile communication terminal are mounted on the printed circuit board 1, and feeding units for feeding electricity to the antenna are respectively provided at one end where the first antenna unit 100 is located and the other end where the third antenna unit 300 is located. In addition, a common ground for commonly grounding the first and second antenna units 100, 200 located at one end and the third antenna unit 300 located at the other end is provided. The common ground may be formed by patterning metallic material on one surface of the printed circuit board 1, but the present disclosure is not limited thereto.

The third antenna unit 300 is located at the other end of the printed circuit board 1 where the first and second antenna units 100, 200 are located. At this time, the third antenna unit 300 is preferably located at the same side as the first and second antenna units 100, 200 with the printed circuit board 1 being interposed between them. In addition, the third antenna unit 300 includes a third feeding port 310 connected to the feeding unit of the printed circuit board 1, a third antenna pattern 320 extending from the third feeding port 310 to emit an electromagnetic wave outwards, and a third ground line 330 connected to the third antenna pattern 320 to be connected to a ground unit located at the common ground of the printed circuit board 1.

The third feeding port 310 of the third antenna unit 300 is connected to a feeding unit different from the first antenna unit 100 to support together with the first and second antenna units 100, 200 so that the antenna may operate as an antenna of a MIMO system.

The third antenna pattern 320 of the third antenna unit 300 is configured so that antenna patterns having different resonance frequencies are aggregated to support various bands. For example, in order to apply a MIMO system, the third antenna pattern 320 may be designed to cover the band of 824 to 960 MHz of GSM850/900 (Global System for Mobile 850/900) corresponding to the first antenna unit 100 or the band of 746 to 787 MHz of LTE13 (Long Term Evolution class13) corresponding to the second antenna unit 200. In addition, the third antenna pattern 320 may also be designed to cover bands of GPS (Global Positioning System), Bluetooth, Wibro (Wireless Broadband), WLAN (Wireless Local Area Network) or the like. However, the present disclosure is not limited to a specific shape of an antenna but may be modified into various antenna shapes.

The third ground line 330 of the third antenna unit 300 is connected to the third antenna pattern 320 to be connected to a ground unit of the common ground of the printed circuit board 1.

In addition, the third antenna unit 300 further includes a current conversion unit 350 spaced apart from the third antenna unit 300 by a predetermined distance and connected to the common ground of the printed circuit board 1.

The current conversion unit 350 is spaced apart from the third antenna unit 300 by a predetermined distance is bent at a right angle as a whole so that its terminal is oriented toward the third antenna unit 300. The current conversion unit 350 is disposed adjacent to the third antenna unit 300 to absorb a current induced from the third antenna unit 300 by means of coupling, and guides the absorbed current to the third antenna unit 300 again through the common ground of the printed circuit board 1, thereby improving the isolation characteristic of the antenna.

Figure 8:
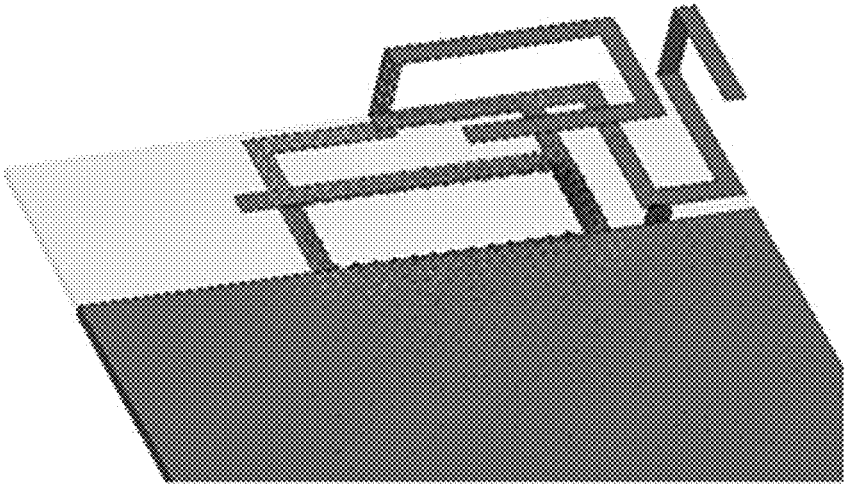
FIG. 8 is a diagram showing current distribution of a third antenna unit employed in the internal antenna of FIG. 7.
Figure 9:
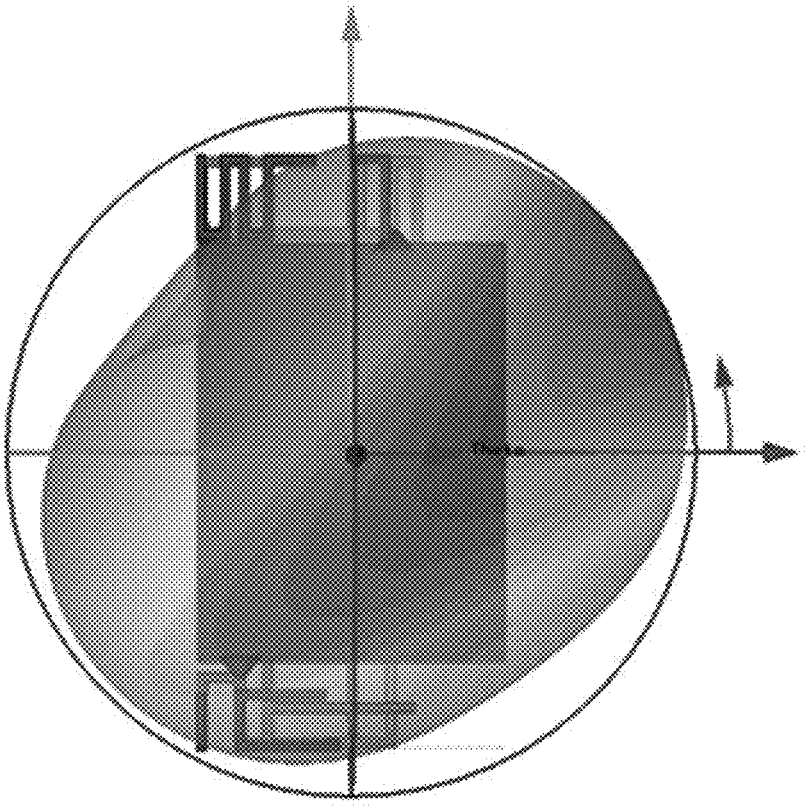
FIG. 9 is a diagram showing 3D radiation patterns of first and second antenna units employed in the internal antenna of FIG. 7.
Figure 10:
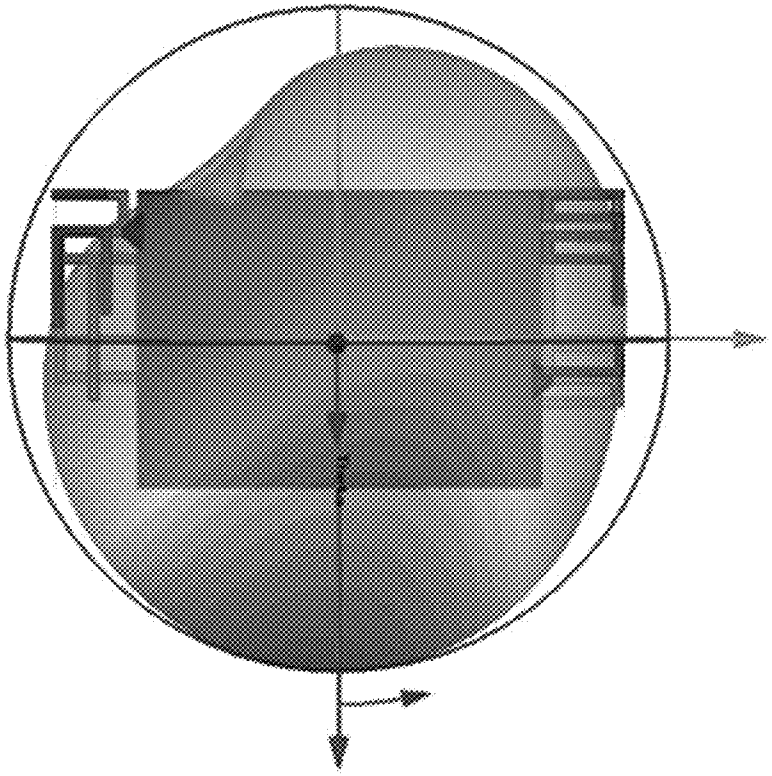
FIG. 10 is a diagram showing a 3D radiation pattern of the third antenna unit employed in the internal antenna of FIG. 7.
Figure 11:
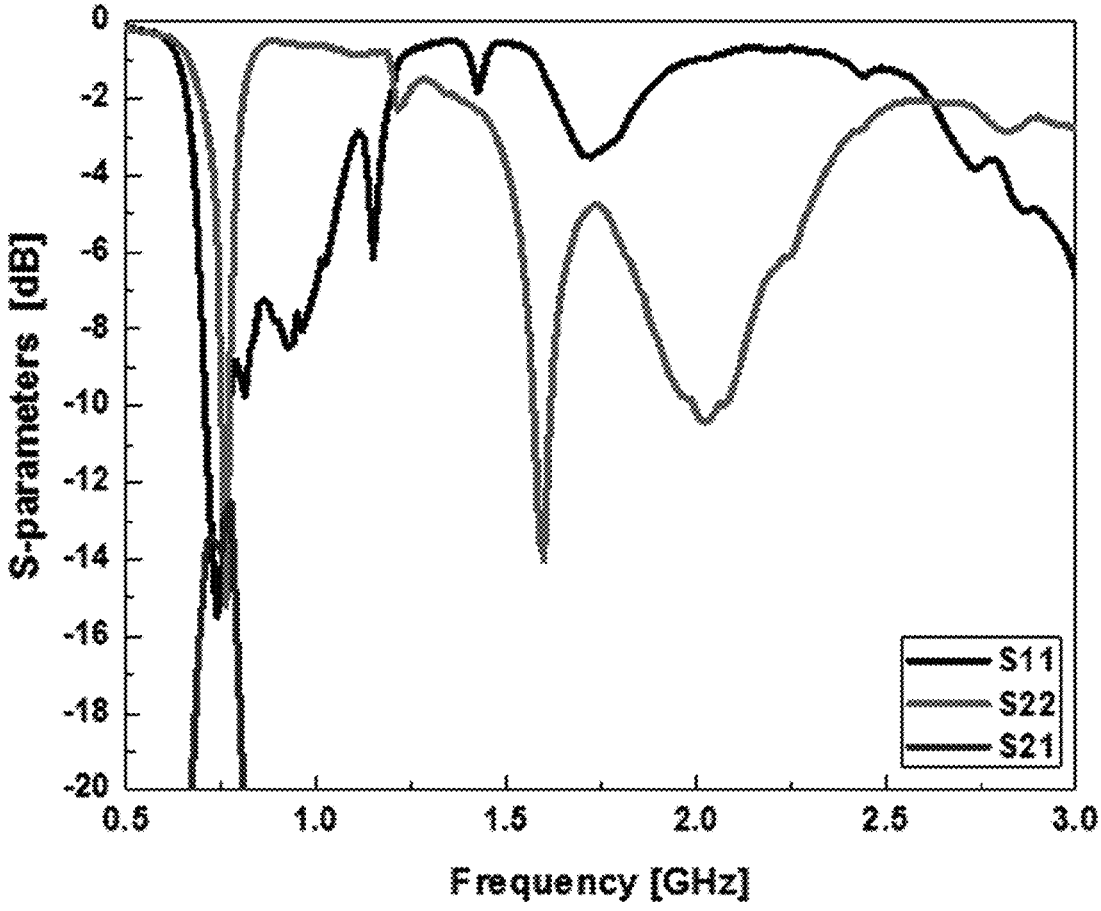
FIG. 11 is a graph showing characteristics of the internal antenna of FIG. 7.

FIG. 8 is a diagram showing current distribution of a third antenna unit employed in the internal antenna of FIG. 7, FIG. 9 is a diagram showing 3D radiation patterns of first and second antenna units employed in the internal antenna of FIG. 7, FIG. 10 is a diagram showing a 3D radiation pattern of the third antenna unit employed in the internal antenna of FIG. 7, and FIG. 11 is a graph showing characteristics of the internal antenna of FIG. 7.

First, as understood from FIG. 8, when the third antenna unit 300 is fed with electricity, electric current flows through the third ground line 330 to the third antenna pattern 320. At this time, the current induced from the third antenna pattern 320 is absorbed by the current conversion unit 350 and then guided to the third ground line 330 of the third antenna unit 300 again through the common ground of the printed circuit board 1. If the amount of current induced from the third antenna unit 300 and flowing to the common ground is decreased, the current flowing to the first and second antenna units 100, 200 located opposite to the third antenna unit 300 may be minimized. Therefore, the isolation between the third antenna unit 300 and the first and second antenna units 100, 200 at the opposite side may be enhanced, and the antenna performance may also be improved.

Meanwhile, FIGS. 9 and 10 respectively show 3D radiation patterns when the first antenna unit 100 and the third antenna unit 300 are fed with electricity, respectively. As shown in FIGS. 9 and 10, the radiation pattern of the first antenna unit 100 is symmetric to the radiation pattern of the third antenna unit 300. Since the first antenna unit 100 and the second antenna unit 200 indirectly fed with electricity therefrom have radiation patterns symmetric to that of the third antenna unit 300, the antenna patterns of the first and second antenna units 100, 200 are orthogonal to the antenna pattern of the third antenna unit 300, thereby ensuring a low correlation (ECC) between the first and second antenna units 100, 200 and the third antenna unit 300.

In addition, it may also be understood that the first and second antenna units 100, 200 and the third antenna unit 300 configured as above cover a communication band of each antenna unit 100, 200, 300 and satisfy the isolation characteristic.

The present disclosure has been described in detail. However, it should be understood that the detailed description and specific examples, while indicating preferred embodiments of the disclosure, are given by way of illustration only, since various changes and modifications within the spirit and scope of the disclosure will become apparent to those skilled in the art from this detailed description.

What is claimed is:

1. An internal antenna having a wideband characteristic, comprising:

a printed circuit board;

a first antenna unit fed with electricity from a feeding unit of the printed circuit board; and a second antenna unit spaced apart from the first antenna unit by a predetermined distance and indirectly fed with electricity by means of coupling to the first antenna unit, wherein the second antenna unit is indirectly fed with electricity with a phase difference from the first antenna unit due to an electric distance from a feeding point of the first antenna unit, wherein the first antenna unit and the second antenna unit are located at one end of the printed circuit board, wherein the internal antenna further comprises a third antenna unit provided at the other end of the printed circuit board and fed with electricity from a feeding unit other than the first antenna unit, wherein the first and second antenna units and the third antenna unit are located on the same side with the printed circuit board being interposed therebetween, wherein the second antenna unit includes:

an indirect feeding line of which one end is connected to a ground unit of a common ground of the printed circuit board and indirectly fed with electricity by being spaced apart from the first antenna unit by a predetermined distance; and a second antenna pattern extending from the other end of the indirect feeding line, emitting an electromagnetic wave, which has a resonance frequency different from that of the first antenna unit, outwards, and being disposed on a different plane from the first antenna unit, and wherein the one end of the indirect feeding line is spaced apart from the feeding point of the first antenna unit as much as an electric distance equal to ¼ of a wavelength λ which corresponds to a central frequency of a operating frequency band of the first antenna unit.

2. The internal antenna having a wideband characteristic according to claim 1, wherein the second antenna unit is indirectly fed with electricity with a phase difference of 90 degrees from the first antenna unit.

3. The internal antenna having a wideband characteristic according to claim 1, wherein the first antenna unit includes:

a feeding port connected to the feeding unit of the printed circuit board;

a first antenna pattern extending from the feeding port to emit an electromagnetic wave outwards; and a ground line connected to the first antenna pattern and connected to a ground unit of a common ground of the printed circuit board.

4. The internal antenna having as wideband characteristic according to claim 3, wherein the first antenna pattern has a terminal located at an edge of the printed circuit board, and an electric distance from the feeding port to the terminal of the first antenna pattern equals to ¼ of a wavelength λ which corresponds to a central frequency of an operating frequency band of the first antenna unit.

5. The internal antenna having a wideband characteristic according to claim 3, wherein the first antenna unit further includes an impedance matching line diverging from the first antenna pattern and improving an impedance matching characteristic of the first antenna unit.

6. The internal antenna having a wideband characteristic according to claim 5, wherein the impedance matching line vertically diverges from the first antenna pattern at as portion in which a surface current is strong, and the impedance matching line is bent at least once so that as terminal of the impedance matching line is oriented toward a ground port of the first antenna unit.

7. The internal antenna having a wideband characteristic according to claim 6, wherein the terminal of the impedance matching line is arranged in parallel to the ground line, of the first antenna unit on the same plane or on different planes.

8. The internal antenna having a wideband characteristic according to claim 1, wherein the second antenna unit has a relatively lower resonance frequency in comparison to the first antenna unit.

9. The internal antenna having a wideband characteristic according to claim 1, wherein the second antenna pattern is bent at least once so that a terminal of the second antenna pattern is located at an edge of the printed circuit board.

10. The internal antenna having a wideband characteristic according to claim 9, wherein the second antenna pattern has a meander form.

11. The internal antenna having a wideband characteristic according to claim 1, wherein the first antenna unit and the second antenna unit are connected to the same surface of the printed circuit board, or wherein the first antenna unit is connected to one surface of the printed circuit board, and the second antenna unit is connected to the other surface of the printed circuit board.

12. The internal antenna having a wideband characteristic according to claim 1, wherein the first antenna unit and the second antenna unit are formed in the space or fixed to a dielectric block formed having a predetermined dielectric constant.

13. The internal antenna having a wideband characteristic according to claim 1, wherein the internal antenna further comprises a current conversion unit disposed at the other end of the printed circuit board at which the third antenna unit is located so that the current conversion unit is spaced apart from the third antenna unit by a predetermined distance, the current conversion unit being connected to a common ground of the printed circuit board, and wherein the current conversion unit is coupled to the third antenna unit to guide a current, induced from the third antenna unit, toward the third antenna unit again.

* * * * *